US005253615A

United States Patent [19]

Heater et al.

[11] Patent Number: 5,253,615

[45] Date of Patent: Oct. 19, 1993

[54] CYLINDER BLOCK CYLINDER BORE ISOLATOR

[75] Inventors: Thomas J. Heater, Milford; Charles R. Dysarz, Dearborn; John V. Counihan, Ann Arbor, all of Mich.

[73] Assignee: Ford Motor Company, Dearborn, Mich.

[21] Appl. No.: 996,537

[22] Filed: Dec. 24, 1992

[51] Int. Cl.[5] ..... F01P 5/10

[52] U.S. Cl. ..... 123/41.74; 123/195 R

[58] Field of Search ..... 123/41.72, 41.74, 195 R

[56] References Cited

U.S. PATENT DOCUMENTS

| | | | |
|---|---|---|---|
| Re. 31,488 | 1/1984 | Trumbauer | 164/32 |
| 1,764,739 | 6/1930 | Meyer | 123/41.72 |
| 3,756,309 | 9/1973 | Nishiyama et al. | 164/369 |
| 4,273,182 | 6/1981 | Winterhalter et al. | 164/137 |
| 4,729,352 | 3/1988 | Fukuo et al. | 123/195 R |
| 4,917,169 | 4/1990 | Melde-Tuczai et al. | 164/369 |
| 5,165,367 | 11/1992 | Morris | 123/41.84 |

FOREIGN PATENT DOCUMENTS 0092690 11/1983 European Pat. Off. .

*Primary Examiner*—Noah P. Kamen

*Attorney, Agent, or Firm*—Roger L. May; Joseph W. Malleck

[57] ABSTRACT

An engine cylinder block having a shallow water jacket in either a V-type, in-line, or opposed engine configuration. The engine cylinder block further having an isolation chamber below the shallow water jacket forming a cavity between the cylinder bore walls and the outer engine block wall. Additionally, ventilation passages are located between the crankcase and isolation chamber through the upper crankcase plate.

9 Claims, 5 Drawing Sheets

CYLINDER BLOCK CYLINDER BORE ISOLATOR

TECHNICAL FIELD

This invention relates to an engine cylinder block design, particularly to a cylinder block casting for an engine with shallow water jackets surrounding its cylinders.

BACKGROUND ART

Typically, engines today are designed to heat up quickly and run at higher operating temperatures than they used to in the recent past in order to reduce emissions and improve fuel economy. To achieve these objectives requires the use of less cooling water to maintain the cylinder bore walls at the desired operating temperature. This development has led to cylinder bore wall configurations in which only the upper portion of the cylinder bore walls are cooled with water rather than extending the full length of the cylinder bore. This is known as a shallow water jacket design. The terms "lower" and "upper," as used herein, refer to the relative relationship of objects to the engine crank axis. Objects which are closer to the crank axis than another particular object are said to be lower than this particular object.

The result of this development in current designs is that the upper portion of the cylinder bore walls is insulated by the water jacket which includes the outer cylinder block wall from ambient conditions within the engine compartment. This leaves the lower portion of the cylinder bore wall exposed at its outside surface to these outside engine ambient conditions. This further results in the reinforcement ribs and bosses for the attachment bolts being cast as extending directly from the cylinder bore wall below the shallow water jackets, which creates a non-uniform cylinder bore wall structure. This, in turn, leads to distortion of the cylinder bore walls due to the uneven stresses and temperatures that each cylinder bore wall now encounters, which can result in increased piston wear or require the use of larger than desired piston-to-bore clearances. In addition, the exposed lower cylinder bore walls lead to increased combustion noise emitted from the engine. Moreover, the shorter outer cylinder block wall reduces the overall stiffness of the engine block requiring additional cast reinforcement ribbing with increased overall weight of the engine block to maintain its overall structural stiffness.

SUMMARY OF THE INVENTION

The object of the subject invention, therefore, contemplates an improved multi-cylinder internal combustion engine block design eliminating the exposed cylinder bore wall below the shallow water jacket. This is accomplished by forming an isolation chamber in the area between the shallow water jacket and the top of the crankcase cavity around the lower portion of the cylinder bore walls, and enclosed within the outer engine block wall. This isolation chamber will reduce the distortion on the lower portion of the cylinder bore walls by equalizing the structure around each cylinder bore wall, equalizing stresses around each cylinder bore wall by affixing any necessary reinforcement ribs to the outer engine block wall and isolating the bolt bosses from the cylinder bore wall. This, in turn, will help to reduce piston wear and improve piston clearances. The isolation chamber will, furthermore, help to reduce the combustion noise emitted from the engine combustion chambers by eliminating the exposed bore walls. The outer engine block wall, running from the cylinder block top deck, which is the upper surface of the cylinder block, all of the way down to the crankcase, also improves overall structural stiffness of the engine block by, among other things, reducing the need for reinforcement ribbing and thereby providing for overall weight reduction of the cylinder block.

More specifically, the subject invention contemplates a multi-cylinder internal combustion engine block being comprised of a plurality of cylinders each having a cylindrical bore surface defined by a cylinder wall formed concentric about a cylinder axis. These cylinder axes are oriented generally perpendicular to an engine crankshaft axis. The cylinder walls each have axially aligned upper and lower ends with a central region therebetween. The lower ends are located between and spaced apart from the crank axis and the upper ends. The engine block, further, has an outer block wall circumferentially surrounding the cylinder walls and extending between the top deck and the crank axis plane. A water jacket web extends radially from the cylinder wall central regions to the outer block wall, which defines a water jacket generally between the water jacket web and the cylinder upper end. Also, the engine block has an upper crankcase plate extending between the cylinder wall lower ends and the outer block wall forming an isolation chamber therebetween which extends from the upper crankcase plate to the water jacket web. The isolation chamber is sealed from the water jacket.

The invention further contemplates ventilation passages provided within the upper crankcase plate and extending therethrough, connecting the isolation chamber to a crankcase cavity which allows passage of the casting core material out of the isolation chamber after the casting process is complete. The ventilation passages also allow passage for crankcase pressure and vapor into the isolation chamber.

BEST MODE FOR CARRYING OUT THE INVENTION

Figure 1:
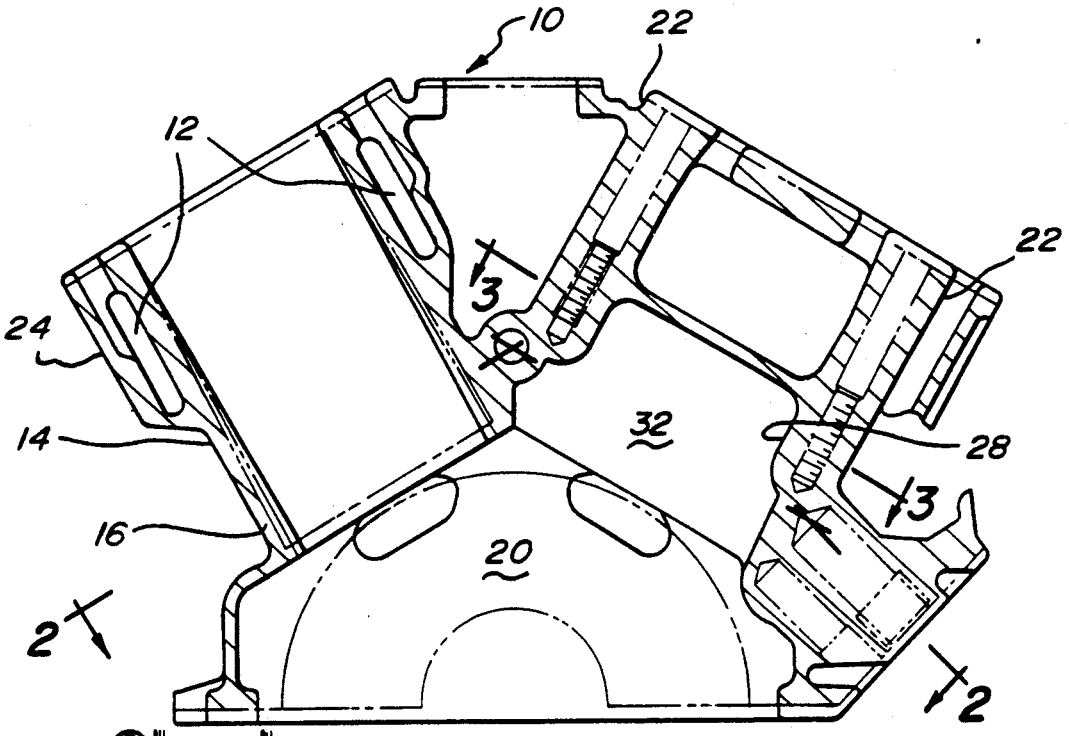
Fig-1 PRIOR ART
FIG. 1 is a side view of cylinders in a prior art V-6 engine taken in cross section along lines 1—1 in FIG. 2.
Figure 2:
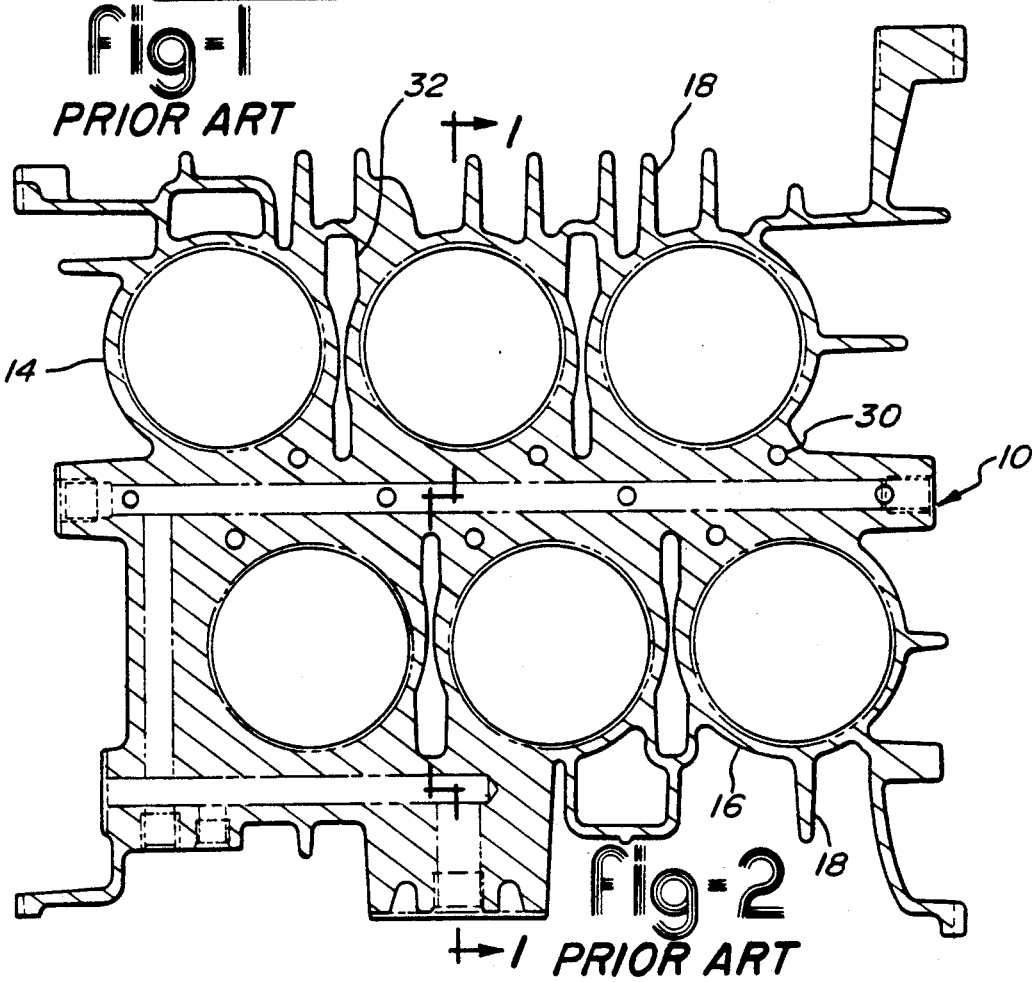
Fig-2 PRIOR ART
FIG. 2 is a plan view of a prior art V-6 engine taken in cross section along lines 2—2 in FIG. 1.
Figure 3:
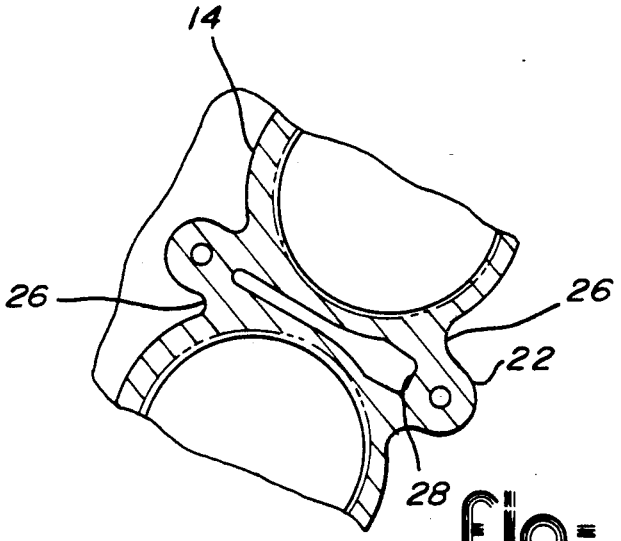
Fig-3 PRIOR ART
FIG. 3 is a cross-sectional view taken along line 3—3 in FIG. 1.

FIGS. 1 and 2 show a typical prior art engine cylinder block 10 with a shallow water jacket 12 surrounding the cylinder bore walls 14, for a V-6 engine configuration. The outer cylinder block wall 24 encloses the shallow water jacket 12 and only extends over the upper portion of the cylinder bore walls 14 a sufficient minimum distance to enclose the shallow water jacket 12. The lower portion of the cylinder bore walls 14 have exposed walls 16. This allows the exposed walls 16 to be exposed to outside engine influences (e.g., ambient temperature fluctuations within the engine compartment) at various locations around the circumference of the lower portion of the cylinder bore walls 14. Additionally, several ribs 18 are affixed directly to the outside of the exposed bore walls 16. Below the cylinders is the crankcase cavity 20. Oil passages 30 are shown in FIG. 2. Along side of the cylinder bore walls 14 are cylinder head attachment bolt bosses 22 which are cast and structurally directly tied to the cylinder bore walls 14 via webs 26 along the lower portion of the cylinder bore walls 14, as shown in FIG. 3. The inner edge of a head attachment bolt boss 22 is denoted 28 in FIGS. 1 and 3. Cavities 32, on the lower portion of the cylinder bore walls 14, are located only between the cylinder bore walls for annular spaced cylinders, and do not exist if the cylinders have siamese spacing.

Figure 4:
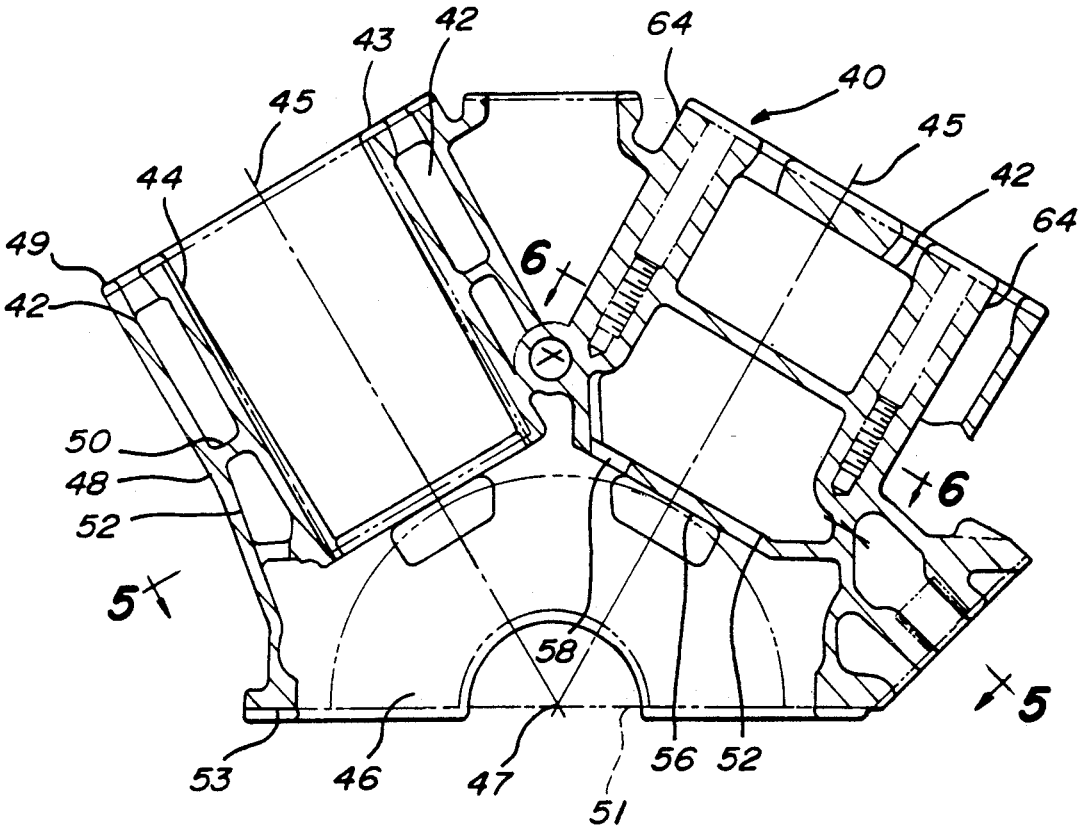
FIG. 4 is a front view of a V-type engine taken in cross section along lines 3—3 in FIG. 4, in accordance with the present invention.
Figure 5:
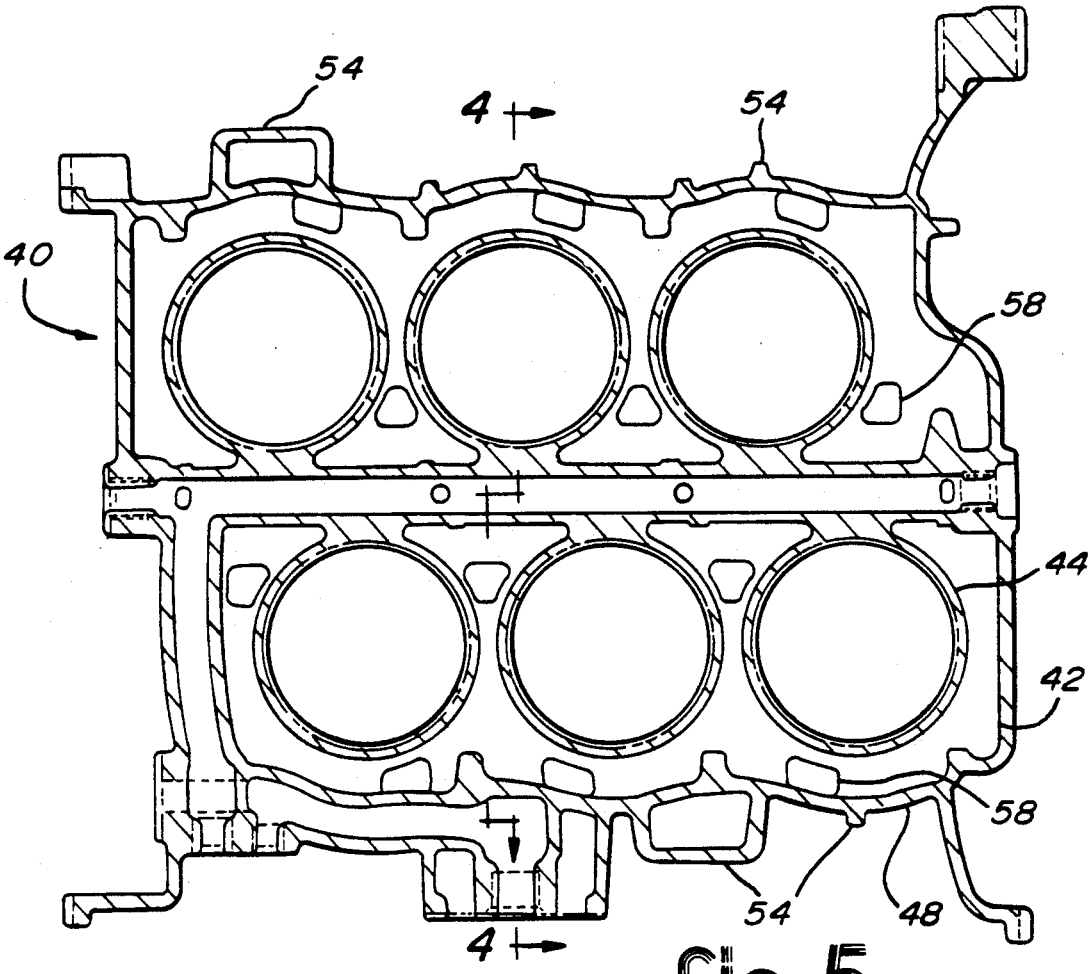
FIG. 5 is a plan view of a V-6 engine taken in cross section along lines 4-4 in FIG. 3, in accordance with the present invention.
Figure 6:
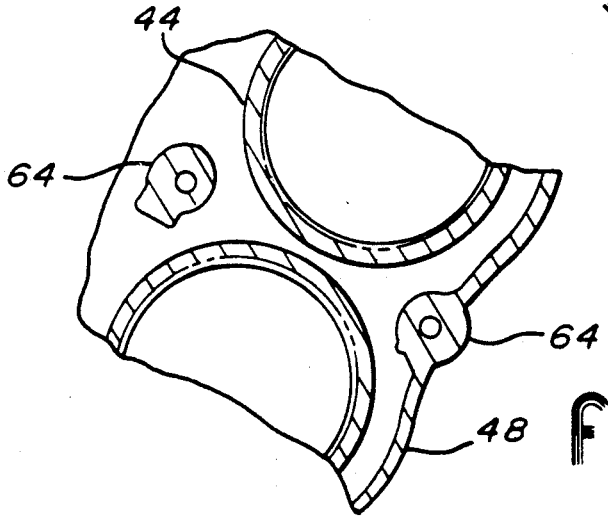
FIG. 6 is a cross-sectional view taken along line 5—5 in FIG. 3, in accordance with the present invention.
Figure 7:
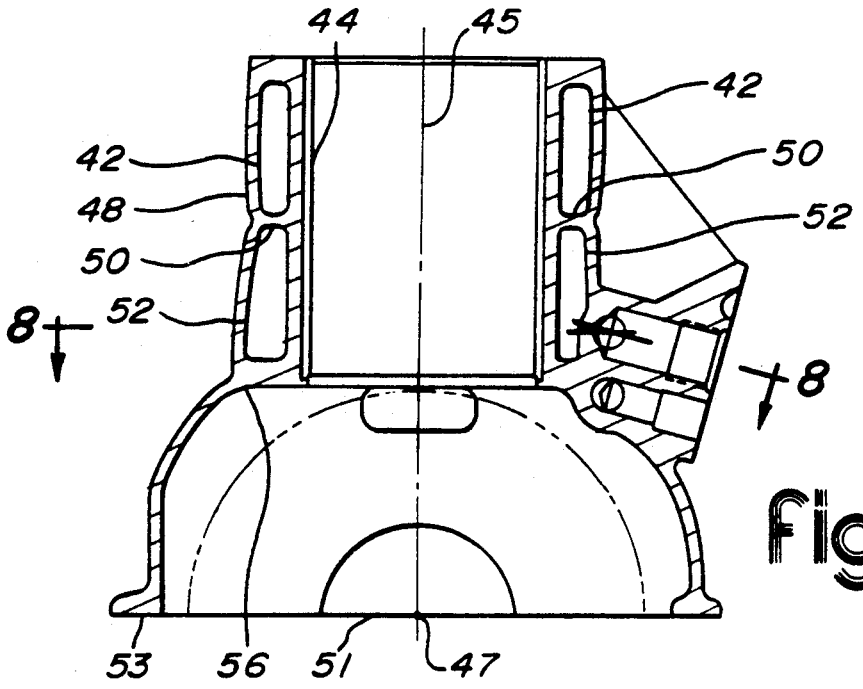
FIG. 7 is a front view of an in-line engine taken in cross section along lines 7—7 in FIG. 8, in accordance with the present invention.
Figure 8:
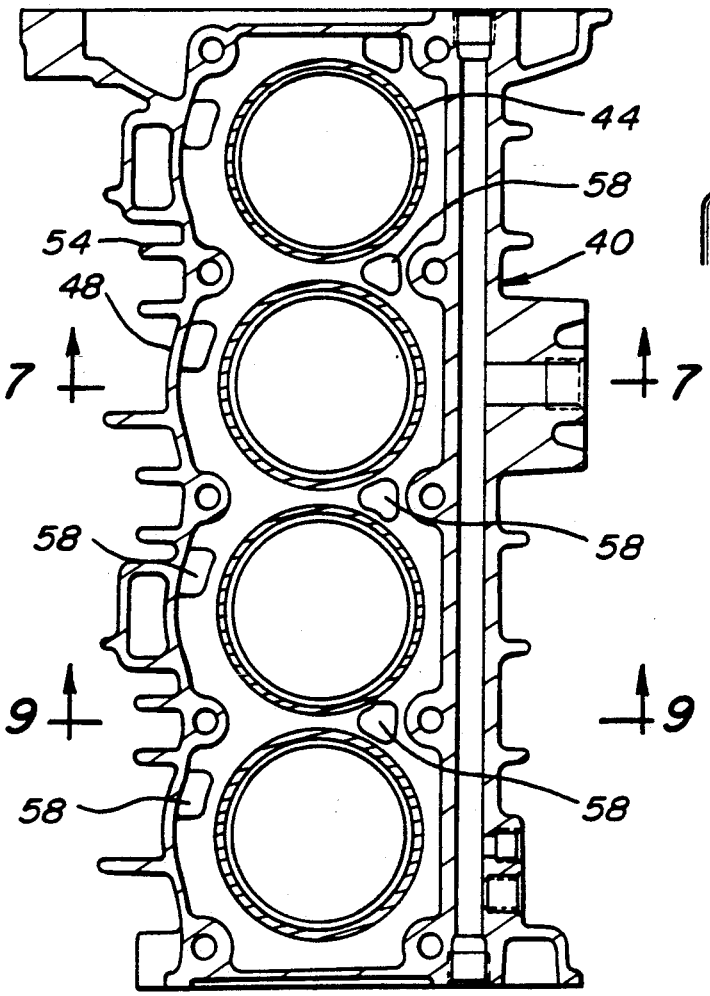
FIG. 8 is a plan view of a four cylinder in-line engine taken in cross section along lines 8—8 in FIG. 7, in accordance with the present invention.
Figure 9:
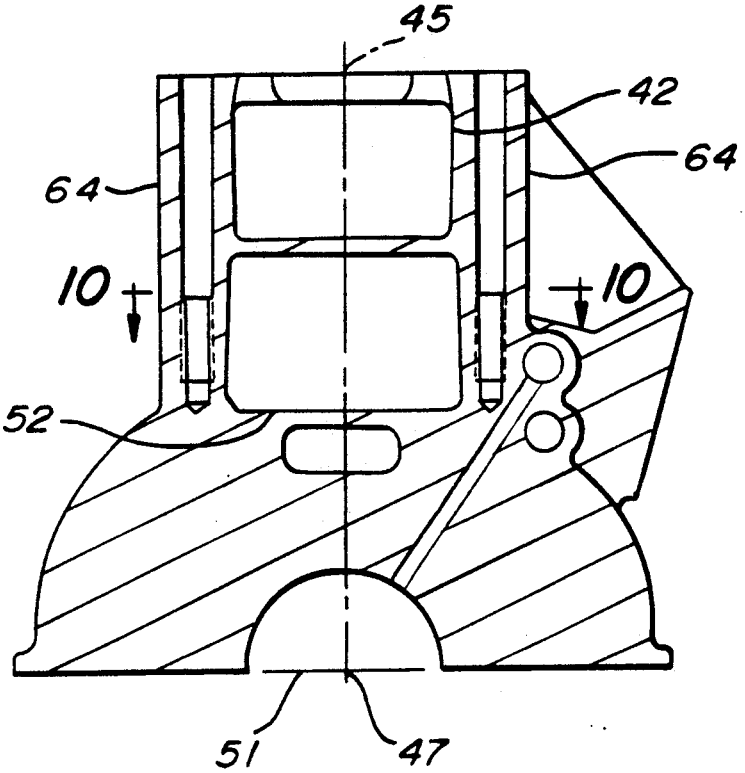
FIG. 9 is a front view of an in-line engine taken in cross section along lines 9—9 in FIG. 8, in accordance with the present invention.
Figure 10:
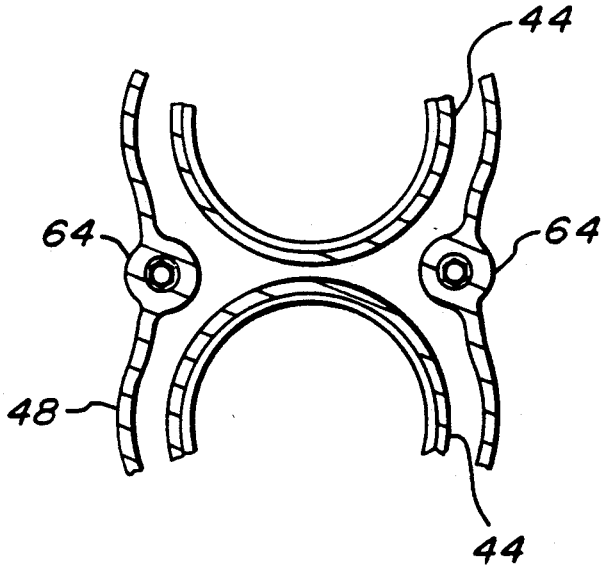
FIG. 10 is a cross-sectional view taken along lines 10—10 in FIG. 9, in accordance with the present invention.

The present invention in a preferred embodiment for a V-type engine block contemplates a configuration as shown in FIGS. 4–6. The aluminum engine cylinder block 40 is a configuration with a shallow water jacket 42 surrounding the upper portion of the cylinder bore walls 44. The cylinder bore walls 44 are cylindrical in shape and each is concentric about its cylinder axis 45. Below the cylinders is the crankcase cavity 46. Within the crankcase cavity 46, the crankshaft, not shown, rotates about a crank axis 47 which is perpendicular to the cylinder axes 45. The crank axis 47 is located within a crank axis plane 51 which is defined by the lower end 53 of the outer cylinder block wall 48. The outer cylinder block wall 48 surrounds the full length of the cylinder bore walls 44, from the cylinder top deck 43 to the crank axis plane 51. The cylinder top deck is that portion of the cylinder block laying in a plane, formed by the upper end 49 of the outer cylinder block wall 48, for each bank of cylinders. The shallow water jacket 42, which surrounds the upper portion of the cylinder bore walls 44, is bounded by the cylinder bore walls 44 and the outer cylinder block wall 48 on its sides, the engine cylinder head (not shown) at its upper end and the water jacket web 50 at its lower end. The water jacket web 50 extends radially between the cylinder bore walls 44 and the outer cylinder block wall 48 about midway between the lower and upper ends of the cylinder bore walls 44.

The water jacket web 50 separates the shallow water jacket 42 and seals it from the isolation chamber 52, which surrounds the cylinder bore walls 44 below the shallow water jacket 42. The isolation chamber 52 is bounded by the lower portion of the cylinder bore walls 44 and the outer cylinder block wall 48 on its sides, and by the upper crankcase plate 56 of the crankcase cavity 46 on its lower side. The upper crankcase plate 56 extends radially between the cylinder bore walls 44 and the outer cylinder block wall 48 at the lower end of the cylinder bore walls 44. The crankcase cavity 46 is located within the outer cylinder block wall 48 extending between the crank axis plane and the upper crankcase plate 56.

With this engine block design, then, any necessary ribs 54 on the cylinder block 10 can be directly affixed to the outer cylinder block wall 48, rather than the cylinder bore walls 44. In the present invention, therefore, the cylinder bore walls 44 are not directly exposed to outside influences as they are completely surrounded by the outer cylinder block wall 48. This equalizes stress and temperature variations on the cylinder bore walls 44 and also creates a greater sound barrier from combustion noise.

Spaced about the crankcase web 56 are crankcase ventilation passages 58, which are holes through the crankcase web 56 allowing for removal of the casting material (not shown) from the isolation chambers 52 after the engine block casting process is complete, while still leaving most of the upper crankcase plate 56 for structural support of the cylinder bore walls 44. The number, size and spacing of the ventilation passages 58 can vary so long as the casting material can be removed. For this embodiment, each cylinder has a pair of ventilation passages 58 located near it to allow for the removal of casting material.

FIGS. 5 and 6 show a pair of cylinder head attachment bolt bosses 64. The lower portion of the cylinder head attachment bolt bosses 64, i.e., the threaded portion below the water jacket web 50, do not directly tie to the cylinder bore walls 44. This is different than the prior art, as is shown by FIG. 3, in which the web 26 directly ties the boss to the cylinder bore wall. As a result, this configuration allows the bolt bosses 64 to be isolated from the cylinder bore walls 44, thus reducing distortion stresses introduced into the cylinder bore walls 44.

The present invention in a second preferred embodiment, for an in-line engine block, contemplates numbers between FIGS. 4–6 and FIGS. 7–10 represent like elements configured for a V-type engine or an in-line engine, respectively. The engine cylinder block 40 is also a configuration with a shallow water jacket 42 surrounding the upper portions of the cylinder bore walls. Below the water jacket 42 is the isolation chamber 52, which is separated from the shallow water jacket 42 by the water jacket web 50. The isolation chamber is bounded by the lower portion of the cylinder bore walls 44 and the outer cylinder block wall 48 on its sides, and by the upper crankcase plate 56 on its lower end. Any necessary ribs 54 can now be directly affixed to the outer cylinder block wall 48, rather than the cylinder bore walls 44 themselves. As in the first preferred embodiment, therefore, the cylinder bore walls 44 are not directly exposed to outside influences as they are completely surrounded by the outer cylinder block wall 48. And, a greater sound barrier from combustion noise is created.

While the best mode for carrying out the invention has been described in detail, those familiar with the art to which this invention relates will recognize that the present invention will also work equally as well for various numbers of cylinders in either an in-line, V-type, or opposed engine configuration. Also while the cylinder spacing in FIGS. 4 and 5 show annular spacing, this invention will also work as well with cylinders spaced in a siamese configuration. Materials such as iron, magnesium or plastic can also be used in the present invention, as well as aluminum, for the engine cylinder block. Therefore, it is to be understood that the present invention is not to be limited to just the embodiments disclosed. Numerous modifications and substitutions are possible without departing from the scope of the claims herein.

We claim:

1. A multi-cylinder internal combustion engine block comprising:

a plurality of cylinders each having a cylindrical bore surface defined by a cylinder wall formed concentrically about a cylinder axis, the cylinder axes oriented generally perpendicular to an engine crank axis, the cylinder walls each having axially aligned upper and lower ends, and a central region therebetween, the lower ends located between and spaced from the crank axis and the upper ends;

an outer block wall, circumferentially surrounding the cylinder walls and extending between a top deck and a crank axis plane;

a water jacket web extending radially from each respective cylinder wall central region to the outer block wall, defining a shallow water jacket generally between the water jacket web and the cylinder upper end, the water jacket web being integral with the cylinder walls and outer block wall; and a second web extending between and integral with the cylinder wall lower ends and the outer block wall and thereby forming an isolation chamber therebetween extending to the water jacket web, said cylinder walls, outer block wall, water jacket web, and second web all being integrally formed to provide a strong, lightweight structure which reduces combustion noise emitted from the engine block.

2. The engine cylinder block of claim 1 wherein the second web is provided with at least one ventilation passage extending therethrough connecting the isolation chamber to a crankcase cavity located between the crank axis plane and the second web.

3. The engine block of claim 2 wherein the at least one ventilation passage is comprised of a plurality of ventilation passages spaced in pairs associated with a respective cylinder wall, each of the associated pairs of ventilation passages located on opposite sides about the respective cylinder wall.

4. The engine cylinder block of claim 1 wherein the second web is a part of an upper crankcase plate.

5. The engine cylinder block of claim 1 wherein the outer block wall is provided with a plurality of cylinder head attachment bolt bosses formed integrally with the outer block wall only and being structurally isolated completely from the cylinder walls below the water jacket web.

6. The engine cylinder block of claim 1 wherein the plurality of cylinders are arranged in a V-type engine configuration.

7. A multi-cylinder internal combustion engine block comprising:

a plurality of cylinders each having a cylindrical bore surface defined by a cylinder wall formed concentrically about a cylinder axis, the cylinder axes oriented generally perpendicular to an engine crank axis, the cylinder walls each having axially aligned upper and lower ends, and a central region therebetween, the lower ends located between and spaced from the crank axis and the upper ends;

an outer block wall, circumferentially surrounding the cylinder walls and extending between a top deck and a crank axis plane, the outer block wall provided with a plurality of cylinder head attachment bolt bosses formed integrally with the outer block wall only and being structurally isolated completely from the cylinder walls at the lower end thereof;

a water jacket web extending radially from each respective cylinder wall central region to the outer block wall, defining a shallow water jacket generally between the water jacket web and the cylinder upper end, the water jacket web being integral with the cylinder walls and outer block wall; and a second web extending between and integral with the cylinder wall lower ends and the outer block wall and thereby forming an isolation chamber therebetween extending to the water jacket web, the second web provided with at least one ventilation passage extending therethrough connecting the isolation chamber to a crankcase cavity located between the crank axis plane and the second web, said cylinder walls, outer block wall, water jacket web, and second web all being integrally formed to provide a strong, lightweight structure which reduces combustion noise emitted from the engine block.

8. A multi-cylinder internal combustion engine block comprising:

a plurality of cylinders each having a cylindrical bore surface defined by a cylinder wall formed concentrically about a cylinder axis, the cylinder axes oriented generally perpendicular to an engine crank axis, the cylinder walls each having axially aligned upper and lower ends, and a central region therebetween, the lower ends located between and spaced from the crank axis and the upper ends;

an outer block wall, circumferentially surrounding the cylinder walls and extending between a top deck and a crank axis plane, the outer block wall being provided with a plurality of cylinder head attachment bolt bosses formed integrally with the outer block wall only and being structurally isolated completely from the cylinder walls;

a water jacket web extending radially from each respective cylinder wall central region to the outer block wall, defining a shallow water jacket generally between the water jacket web and the cylinder upper end, the water jacket web integral with the cylinder walls and outer block wall; and a closure means for integrally extending between the cylinder wall lower ends and the outer block wall and thereby forming an isolation chamber therebetween extending to the water jacket web, the closure means comprised of a second web extending about the entire circumference of and integral with each respective said cylinder wall to thereby enclose the isolation chamber.

9. The engine cylinder block of claim 8 wherein said second web constitutes an upper crankcase plate defining the extremities of said crankcase cavity.

* * * * *